United States Patent [19]

Kissel

[11] Patent Number: 4,519,198

[45] Date of Patent: May 28, 1985

[54] YARN SPINNER

[76] Inventor: Thomas L. Kissel, 606 S. Rural St., Hartford, Wis. 53027

[21] Appl. No.: 531,449

[22] Filed: Sep. 12, 1983

[51] Int. Cl.[3] ..... D01H 3/00; D01H 7/26; D01H 7/36

[52] U.S. Cl. ..... 57/71; 57/67; 57/100; 57/316

[58] Field of Search ..... 57/67–71, 57/316, 100

[56] References Cited

U.S. PATENT DOCUMENTS

| | | | |
|---|---|---|---|
| 246,251 | 8/1881 | Voegtli | 57/316 |
| 2,538,189 | 1/1951 | Caron | 57/316 |
| 2,623,347 | 12/1952 | Bishop | 57/71 X |

*Primary Examiner*—John Petrakes

[57] ABSTRACT

A yarn spinner has two spaced apart upstanding posts whose upper ends each have a slot for receiving and journalling opposite ends of a spindle shaft. A flyer formed by a wire constituting a guide has a loop formed in it through which spun yarn is diverted to a distributor. The distributor is a v-shaped spring clip having a hole in each side for passing over the guide wire and a ring is suspended in the apex of the V through which the yarn is threaded for diverting it to a bobbin on the spindle. Pressing the sides of the spring clip toward each other releases it for movement on the guide wire and releasing the sides re-engages it with the wire. A tensioner line running over the bobbin has a rubber band in it and a capstan allows winding and unwinding line to increase and decrease the stretch of the rubber band to corresponding change the frictional drag on the bobbin.

2 Claims, 2 Drawing Figures

YARN SPINNER

BACKGROUND OF THE INVENTION

The invention disclosed herein pertains to an improved yarn spinner that permits formation or spinning of yarn from fibers as is done with traditional wooden spinning wheels.

Wooden spinning wheels used in the home have an air of romanticism about them but they have never been optimized for operating convenience, nor for simplicity, or cost. Most if not all spinning wheels require a substantial amount of floor space to be dedicated to them and they are so large that most homes do not have accommodations for storing them off-the-floor and out of sight when not in use.

Prior art spinning wheels are usually driven by means of a foot treadle that operates a crank shaft which turns a fly wheel and a bobbin on which the spun yarn is wound. Since foot power is required, the traditional spinning wheel cannot be used by those who are physically weak, or paralyzed, or confined to a wheelchair; a class of people who might have a strong desire and, indeed, a need for the therapy and sense of accomplishment that can be achieved by personally spinning their own yarn. Moreover, even a healthy spinning enthusiast can become fatigued and prematurely bored due to the energy which must be expended on the treadle and to the relatively low output of yarn for the time and effort spent.

It should be noted too that traditional wooden spinning wheels are comprised of many parts that require considerable craftmanship to make and assemble them, such that the manufacturing cost and sale price are necessarily higher than they might be. There are many structural features in traditional spinning wheels that make their use slow and inconvenient. Generally, to insert or remove a bobbin, for example, requires unlatching or latching and turning some wooden member to permit the bobbin shaft to be positioned for removing or installing a bobbin. The wooden flyers that orbit around the bobbin for distributing the yarn over its length are usually provided with a series of axially spaced apart hooks and the incoming yarn is switched from hook to hook as spinning proceeds to distribute the yarn or prevent winding a lot of it at one place on the bobbin. In one prior art spinning wheel the flyer has a body having an eye slidable on it. The yarn is fed through the eye just before it goes onto the bobbin. The body has a set screw for clamping it to the flyer at various positions along the length of the flyer to obtain winding of the yarn at different places or in a distributed fashion on the bobbin. To switch the body from one position to another requires shutting down of the spinning operation for the time it takes to loosen the screw, shift the body to a new position and tighten the set screw again which slows down production and is tedious.

In spinning devices, the speed of the bobbin must be regulated relative to the speed at which the wheel is rotated to spin the yarn in order to get the proper tension on the yarn and thereby control the tightness to which it is wound on the bobbin. There are a variety of tensioners used in traditional wooden spinning wheels. One type has a wooden screw on which there is a projecting wood handle that must be turned to increase or decrease tension on the drive belt. In another type the tension on the drive belt is adjusted by loosening a wing nut on a clamp and grasping a handle and tipping the flyer assembly relative to the drive wheel and then retightening the wing nut. These are but two examples of tensioners that are inconvenient to use.

SUMMARY OF THE INVENTION

In accordance with the invention, a yarn spinner is provided which is compact, light weight, storable in a modest amount of space, highly portable, simple to use, highly productive and motor driven.

The new spinner is structurally distinguished by having the drive pulley and spindle on a common shaft and having the shaft journaled in open slots at the top of spaced apart posts. This arrangement enables easy removal and replacement of bobbins. The flyer is not wood as in the prior art but is a relatively thin, light weight and stiff guide wire for supporting a yarn distributor device. The yarn distributor device is mounted for sliding on the flyer or guide wire and is unique in that it is basically a clip that only has to be squeezed on both sides between a finger and a thumb to release it for sliding over a large or small increment of axial distance. Removal of finger pressure effects gripping of the distributor to the wire flyer.

Tensioning or drag force on the bobbin is achieved with a tension line that runs over the bobbin to a capstan which is conveniently placed for turning it in one direction or another for varying tension. In the preferred embodiment, a simple rubberband is used in series with the tension line and serves the purpose of a more costly coil spring which might otherwise be used to impose a tensile force on the tension line. The motor shaft has a three-step pulley for driving the spindle pulley through a belt. Thus, in the preferred embodiment at least three spindle speeds are available. The belt is readily accessible for twisting it before putting it on the motor pulley in which case the spindle will turn in a direction that is suitable for plying two yarn strands together and in a rotational direction that is opposite that required for forming or spinning a yarn. By way of example and not limitation, the commercial embodiment of the yarn spinner has all the mechanism mounted on a baseboard that is only about 12 inches square and the overall height of the spinner is only about 8 inches.

The spinner is suitable for spinning a variety of fibers into yarn such as mohair, angora, alpaca, camels hair, rayon, silk and wool, for example. An illustrative embodiment of the new spinner will now be described in greater detail in reference to the drawing.

DESCRIPTION OF A PREFERRED EMBODIMENT

Figure 1:
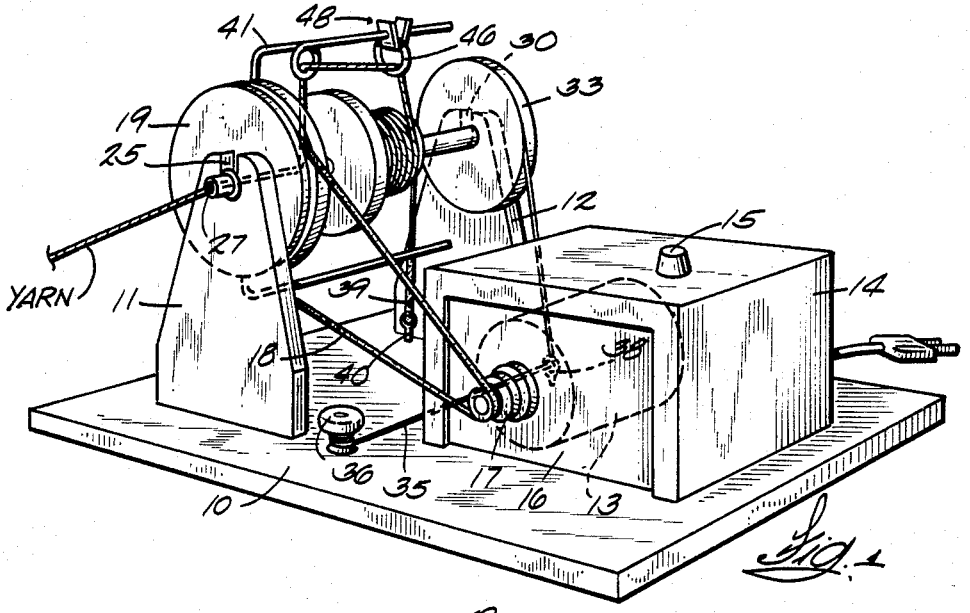
FIG. 1 is a perspective view of the spinner.

Referring to FIG. 1, the spinner is comprised of a base plate 10 which, in an actual embodiment, is made of wood. There are two upstanding axially spaced apart posts 11 and 12 fastened to base 10. An electric motor 13 drives the spinner and is depicted in dashed lines contained within a housing 14. A knob 15 on the top of housing 14 controls a switch, not shown, for energizing and deenergizing the motor. The shaft of the motor extends through a hole in the front wall 16 of housing 14. The shaft has a three-step pulley 17 fastened to it. A belt 18 runs in any one of the three different diameter grooves in motor pulley 17 for driving a larger spindle pulley 19 at any one of three speeds which are all lower than the rotational speed of motor 13 and which are obtained by shifting the belt from one of the three grooves in pulley 17 to another one having a different diameter. Belt 18 is preferably made of an elastic material such as rubber which is stretchable to make it easy to remove from and replace on drive pulley 17. With the belt positioned as in FIG. 1, the rotational direction of the motor shaft is such that multiple groove pulley 17 and spindle pulley 19 rotate in a clockwise direction as indicated by the arrow on pulley 19. In this embodiment, this is the direction that is ordinarily used when yarn is being spun. On the other hand, for plying two yarns together to form a single heavier strand, spindle pulley 19 is caused to rotate counterclockwise. Changing rotational direction of the spindle pulley 19 is accomplished by removing belt 18, putting a single twist in it, and restoring it to pulleys 17 and 19.

Figure 2:
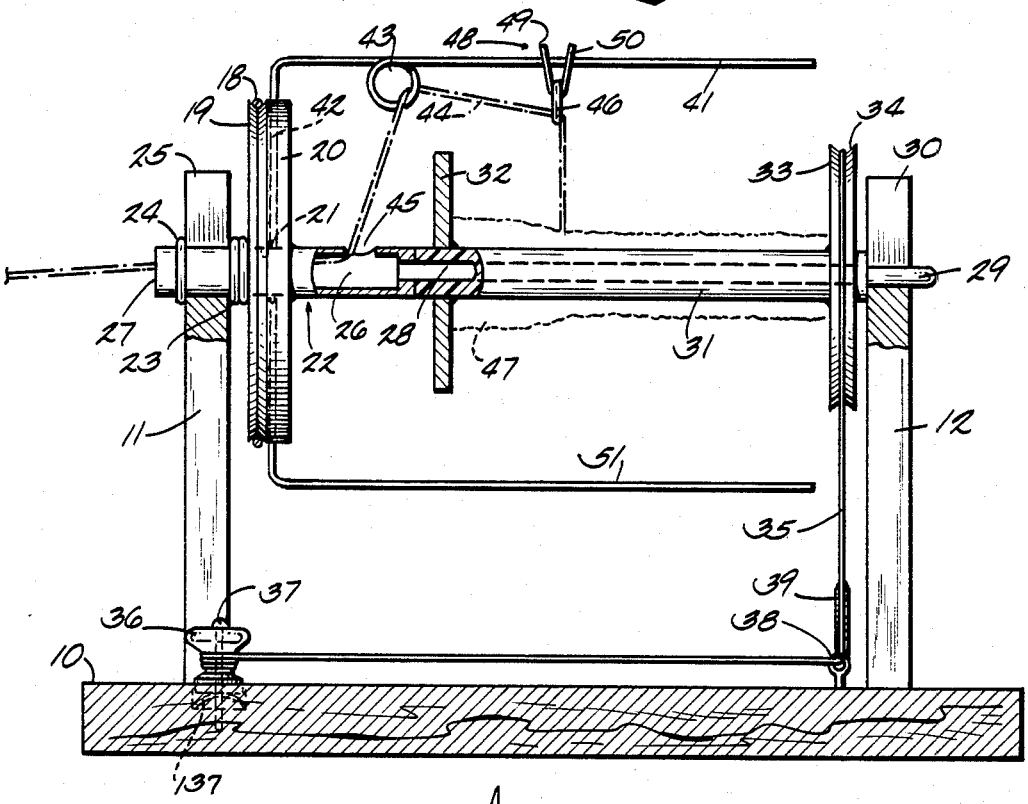
FIG. 2 is a view taken from the left side of FIG. 1 without showing the motor housing in the background and with some parts in section.

The details of the spindle and bobbin assembly can be seen best in FIG. 2. FIG. 2 shows belt 18 in section residing in a v-groove in pulley 19. In the commercial embodiment, pulley 19 is turned out of wood. Pulley 19 has a wood disc 20 interfacing it. The pulley and disc may be formed out of a single piece of wood, but, in this case they are separate pieces which are glued together at their interface. Pulley 19 and interfacing disc 20 have a central bore 21 through which a hollow or tubular shaft member 22 tightly fits. The pulley and disc are preferably secured to shaft member 22 with an adhesive such as epoxy resin. Spacer rings 23 that may be nylon or other low friction material are adhered to the periphery of shaft member 22 and serve to keep the pulley accurately spaced relative to stationary post 11. A retainer ring 24 is also fastened to the periphery of shaft member 22 so that in cooperation with rings 23 end play of the shaft member will be prohibited. The hollow shaft member 22 is part of a spindle assembly and rests in the semi-circular bottom of a slot 25 in the top end of post 11. Shaft member 22 is thereby journaled for rotation in open topped slot 25.

Hollow or tubular shaft member 22 can be made by boring an axial hole 26 part way through a solid metal rod desirably comprised of brass. The bore provides a yarn input orifice 27 at the end of shaft 22. The closed end of tubular shaft member 22 is suitably bored axially for receiving a tightly fitting rod or solid shaft member 28. Thus, the two shaft members 22 and 28 are joined to form a unitary spindle shaft. The free end 29 of solid shaft member 28 fits into a slot 30 in the top end of post 12. Slot 30 is just wide enough for free end 29 of the shaft to fit into it and be journaled on the semi-circular bottom of the slot. It will be evident from the description thus far that when spindle pulley 18 is driven rotationally, disc 20 will also rotate and shaft member 22 and its coaxial shaft member 29 will turn together.

A bobbin is presently fitted on shaft member 29. The bobbin is comprised of a tubular core 31 having an axial bore just slightly larger than the outside diameter of solid shaft member 29. A disc 32 is fastened to one end of the bobbin core and another disc 33 is fastened to the other end by means of a suitable adhesive preferably. In an actual embodiment, the discs are wood and the core is acrylic resin. The bobbin is free to rotate at a speed that differs from and is invariably set less than the rotational speed of driven spindle pulley 18 during the yarn strand spinning operation. Bobbin speed is controlled by a tensioner as will be explained momentarily.

Disc 33 at one end of the bobbin has a peripheral groove 34 which is v-shaped in cross-section somewhat similar to a pulley. A tension line 35 overlays about one-half of the circumference of disc 33 and serves as a braking element that imposes a retarding frictional force on the wooden disc 34 for the purpose of slowing it down any desired amount relative to the solid spindle shaft 28 on which the bobbin is journaled for rotation. Although the tension line 35 can be composed of a variety of materials, in a commercial embodiment it is comprised of a nylon monofilament which by its nature is slippery and long lasting. Bobbin end disc 32, as well, is turned out of wood and with bobbin tube or axle 31 being a plastic tube, the bobbin contributes to the objective of having all parts of the spinner inexpensive, strong and light weight. Tension line 25 has several turns at one of its ends wound around a spool or capstan 36. Capstan 36 is held down on base 10 by means of a screw 37 that is turned into base 10 and whose shank is small enough for permitting the axially bored capstan to turn on it. There is a spring washer 137 under the capstan. By turning the screw 27 down tightly enough against the capstan, the spring is stressed to impose enough frictional force on the capstan to hold its rotary position and yet permit the user to turn the capstan for varying the tension on tension line 35 by winding on or paying out tension line from the capstan. As can be seen in FIG. 2, the tension line runs from the capstan to an eye screw 38 which is screwed into base 10. After passing through the eye, it will be evident from FIGS. 1 and 2 that the course of the tension line is over about one-half of the circumference of disc 33. As can be seen in FIG. 1 particularly well, after the tension line passes over disc 33 it descends to a terminal elastic element 39 to which the line is fastened. In the interests of cost reduction and simplicity and ease of replacement parts, in the commercial embodiment elastic element 39 is actually a closed-loop rubberband that is anchored at one end by hooking it into an eye screw 40 which is screwed into base 10. Thus, the rubberband 39 maintains the tension line 35 in tension at all times during spinner operation. When more tension line 35 is wound on to capstan 36, rubberband 39 extends and there is more tensile stress in the line, and, hence, greater frictional drag is exerted on bobbin disc 33 so it will rotate more slowly. Of course, when capstan 36 is turned in a direction to reduce the amount of stretch in rubberband 39, less frictional drag will be created on bobbin disc 33 so it will rotate faster relative to solid spindle shaft 28.

A flyer constituting part of a shuttle arrangement for distributing yarn uniformly over the bobbin core is formed with a single wire 41 instead of wood as was the case in prior art designs. Portion 42 of the flyer or guide wire 41 fits in a groove in disc 20 which turns with the spindle pulley 18 so the flyer 41 can orbit around the bobbin when it rotates. The portion 42 is curved at its center around shaft 22 to give it stability. The guide wire has a loop or eye 43 formed in it which serves as one of the guide passageways for the yarn strand 44 which is being spun. As can be seen in both figures, the yarn strand is fed through the orifice 27 of tubular shaft member 22 and emerges from the member 22 through a radial hole 45 from which it passes through eye or loop 43 and an eyelet ring 46 from which it winds on the bobbin as indicated by the accumulation of yarn marked 47. Eyelet 46 is preferably a nylon ring and it resides in the bottom of a clip 48 which is formed from a strip of springy metal into a v-shaped configuration having two sides 49 and 50 defining the v. There are substantially aligned holes through the two sides so the clip can be slid on to flyer wire 41 from its end. The combination of eyelet 46 and spring clip 48 constitutes a yarn distributor for directing the yarn to any desired location along the axial length of the bobbin spindle 31. Once the yarn is fed through eyelet 46, all that is necessary to direct the yarn to a different region on the bobbin is for the user to grasp sides 49 and 50 of the spring clip between his or her fingers and press them together so that the holes in the sides are more nearly aligned in which case the clip can be freely slid in either direction along the flyer or guide wire 41. When the finger pressure is removed, sides 49 and 50 of the clip spring outwardly and the edges of the holes in the clip sides bite into the wire 41 to maintain the clip in the position in which it has been set. Another wire 51 is fastened to disc 20 diametrically oppositely of the guide wire or flyer 41 for the sake of counterbalancing the functional flyer 41. The yarn distributor 48 is much easier to reposition than distributors in prior art spinning wheels in that there is no need to transfer yarn from one distributor hook to another nor to unscrew any part as was required in prior art spinning wheel distributors.

For accomplishing spinning, a mass of any carded fiber such as wool, called a rolag, must be available. To initialize the machine for spinning, the unit spindle shaft members carrying the bobbin are lifted out of their post slots. The bobbin is then preferably removed from the solid spindle shaft 28 for the purpose of tying or taping a short piece of yarn constituting a leader to the core 31 of the bobbin. The bobbin is then slipped onto the spindle shaft 28 and the shaft and bobbin assembly is deposited in slots 25 and 30 of posts 11 and 12. The leader yarn is then threaded backwards through eyelet 46 of distributor clip 48 and then through loop 43 that is formed in the metal guide wire flyer 41. The leader is then fed back through radial hole 45 in hollow shaft member 22 and is pulled through the bore 26 with a wire hook, not shown, until the free end of the leader emerges from the orifice 26. Some yarn is then drawn out or extended from the rolag and the leader is tied to the extending portion. When the spindle was dropped into the bearing slots, the drive belt 18 was looped with no twist in it over spindle pulley 19. Thus, the next step is to put the drive belt in one of the motor pulley's 17 grooves that will provide a spindle rotational speed suitable for the spinning skill of the user. The rubber-band 39 of the tension line is then engaged on stationary hook 40 while tension line 35 is loose so that the line can be brought over the edge of bobbin disc 33. After that the capstan 36 is turned to create some tension in line 35. The machine is now ready for spinning yarn.

The spinning technique is basically traditional. The rolag is placed in the left hand with the leader yarn on top. The motor is turned on. The leader yarn begins to turn and starts latching on to loose fibers of the rolag and starts to draw them through the orifice 27 at the end of shaft member 22. Meanwhile the bobbin is rotating somewhat slower than the flyer wire 41. The yarn strand is grasped between the finger and thumb of the right hand and the rolag is pulled toward the body with the left hand. The right hand fingers are slid down along the fibers but the finger grip is not released so the twist will go into the rolag. The spun or twisted yarn is fed continuously to the bobbin. Just enough tension is put on the bobbin to pull in the yarn and cause it to twist and get kinky. Clip 48 and the yarn distribution ring 46 with it are moved back and forth intermittently on the guide wire by pressing the clip together and releasing it where stopping is desired to achieve filling the bobbin evenly. The spinning routine then continues with pulling out fibers from the rolag, holding the fiber about 6 inches from the orifice to prevent the twist from backing into the rolag, allowing fibers to twist for strength and assisting the yarn to feed in by moving the hands toward the orifice 27.

Plying two strands together for strengthening and for obtaining different thicknesses, types and colors can be accomplished on the new spinner by traditional methods. The procedure for getting the two yarns started with a leader is similar to that described earlier in connection with making a single strand of yarn. However, the two strands must be twisted in a direction opposite from that in which they were twisted originally. This means that the spindle pulley 19 shown in FIG. 1 must rotate counterclockwise for plying. In the new spinner the change in rotational direction is easily achieved by simply removing belt 18 and putting a twist in it and restoring it to the spindle and motor pulleys.

Although a preferred embodiment of the invention has been described in considerable detail, such description is intended to be illustrative rather than limiting, for the invention may be variously modified and is to be limited only by interpretation by the claims that follow.

I claim:

1. A yarn spinner comprising:

a wooden base, a pair of upstanding wooden posts mounted to said base and spaced from each other, each of said posts having a slot aligned with the other and at substantially the same distance above the base, the said slots providing bearing surfaces, spindle means including a tubular shaft member providing an orifice at one end for entering yarn and having an opposite end, said shaft member having a radial hole for the yarn to exit, and including another shaft member for supporting a bobbin joined coaxially to said tubular shaft member at said opposite end to thereby provide a unitary spindle shaft assembly whose opposite ends can be dropped in said slots in the posts, respectively, to journal said assembly for rotation, a spindle pulley means fastened concentrically to said tubular shaft member and comprised of two concentric interfacing wooden discs bonded together, one of the discs having a peripheral groove for a driving belt to run in, at least one of said discs having a continuous groove in its surface that interfaces with the other, said groove including two diametrically opposite radially outwardly extending portions and a curved portion connecting the radially inward ends of said two portions, said curved portion allowing for passing around said tubular shaft member, a flyer composed of a single piece of wire having two axially extending guide portions terminating in free ends and arranged in parallelism with each other and with the axis of said shafts and substantially equally radially spaced from said axis, and said wire having an intermediate portion disposed between said axially extending portions, said intermediate portion having a shape that is complementary to the shape of said groove at the interfaces of said disc and is registered in said groove for said flyer to rotate with said pulley means, a distributor device mounted on one of said axially extending wire portions of said flyer for being moved axially thereof and having means for spun yarn to pass through for being directed to selected regions along a bobbin supported on said shaft, and an electric motor having a shaft and a pulley thereon for a belt that couples said pulley in driving relation with said spindle pulley means.

2. The spinner according to claim 1 wherein said distributor device comprises:

a spring metal strip formed as a v-shaped clip to provide two sides diverging from each other, each side having a hole aligned with the other for slipping over said guide portion of said flyer wire when said diverging sides are pressed toward each other, whereby when said sides are released, said sides will spring away from each other and cause the margins of said holes to bite into said guide portion of said flyer wire to maintain the position of the clip, and a ring at the apex of the clip through which yarn may be threaded to direct it toward the selected bobbin region.

* * * * *